US008292458B2

(12) United States Patent
Bertram et al.

(10) Patent No.: US 8,292,458 B2
(45) Date of Patent: Oct. 23, 2012

(54) LIGHT EMITTING DIODE LAMP COMPRISING ONE LED CONSUMING A FIRST ELECTRICAL POWER AND ONE RADIATION-EMITTING SEMICONDUCTOR COMPONENT CONSUMING AN ELECTRICAL DISSIPATION POWER

(75) Inventors: Ralph Peter Bertram, Nittendorf (DE); Robert Kraus, Regensburg (DE)

(73) Assignee: Osram AG, Munich (DE)

( * ) Notice: Subject to any disclaimer, the term of this patent is extended or adjusted under 35 U.S.C. 154(b) by 653 days.

(21) Appl. No.: 12/055,798

(22) Filed: Mar. 26, 2008

(65) Prior Publication Data

US 2008/0265789 A1 Oct. 30, 2008

(30) Foreign Application Priority Data

Mar. 29, 2007 (DE) ..... 10 2007 015 233

(51) Int. Cl.
*F21V 9/00* (2006.01)

(52) U.S. Cl. ..... 362/231; 362/230; 362/227; 362/800; 362/362

(58) Field of Classification Search ..... 362/6, 8, 362/12, 11, 17, 18, 2, 611–613, 553, 552, 362/555, 510, 509, 543–545, 546, 647, 650, 362/651, 227, 228, 230, 231, 259
See application file for complete search history.

(56) References Cited

U.S. PATENT DOCUMENTS

| | | | | |
|---|---|---|---|---|
| 4,963,798 | A * | 10/1990 | McDermott | 315/312 |
| 6,227,679 | B1 * | 5/2001 | Zhang et al. | 362/236 |
| 6,268,702 | B1 | 7/2001 | Fleck | |
| 7,005,679 | B2 * | 2/2006 | Tarsa et al. | 257/89 |
| 7,192,160 | B2 * | 3/2007 | Reiff et al. | 362/231 |
| 7,633,406 | B2 * | 12/2009 | Miki | 340/825.52 |
| 2002/0196639 | A1 | 12/2002 | Weidel | |
| 2004/0174712 | A1 | 9/2004 | Yagi | |
| 2004/0240219 | A1 | 12/2004 | Oishi et al. | |
| 2005/0083686 | A1 | 4/2005 | Yatsuda et al. | |
| 2006/0018118 | A1 * | 1/2006 | Lee et al. | 362/231 |
| 2006/0164853 | A1 | 7/2006 | Moisel | |
| 2007/0138978 | A1 * | 6/2007 | Rains et al. | 315/291 |
| 2008/0106887 | A1 * | 5/2008 | Salsbury et al. | 362/84 |

FOREIGN PATENT DOCUMENTS

| | | |
|---|---|---|
| DE | 201 07 173 | 8/2001 |
| DE | 697 11 069 | 11/2002 |
| DE | 101 29 743 | 1/2003 |
| DE | 101 30 809 | 1/2003 |
| DE | 102 61 183 | 3/2004 |
| DE | 102004010875 | 10/2004 |
| DE | 102005041065 | 8/2006 |
| EP | 1 759 922 | 3/2007 |
| JP | 2005-81902 | 3/2005 |

* cited by examiner

*Primary Examiner* — Tuyet Thi Vo
(74) *Attorney, Agent, or Firm* — Fish & Richardson P.C.

(57) ABSTRACT

An LED lamp is specified, comprising at least one LED and at least one radiation-emitting semiconductor component, it being the case that when the LED lamp is operating, the at least one LED emits visible light and the at least one radiation-emitting semiconductor component emits electromagnetic radiation having a peak intensity outside the visible region of the spectrum.

20 Claims, 2 Drawing Sheets

Figure 1:
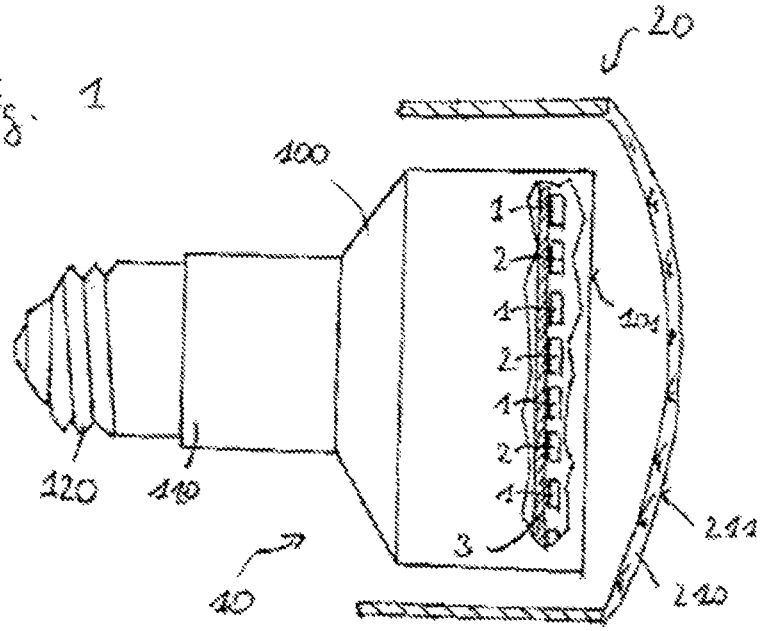

LIGHT EMITTING DIODE LAMP COMPRISING ONE LED CONSUMING A FIRST ELECTRICAL POWER AND ONE RADIATION-EMITTING SEMICONDUCTOR COMPONENT CONSUMING AN ELECTRICAL DISSIPATION POWER

LED lamp, light comprising an LED lamp, method for operating a light and method for generating an electrical dissipation power in association with an LED lamp This patent application claims the priority of German Patent Application 102007015233.9, whose disclosure content is hereby incorporated by reference.

The invention concerns an LED (Light Emitting Diode) lamp, a light comprising an LED lamp, a method for operating a light and a method for generating an electrical dissipation power in association with an LED lamp.

LED lamps usually have a higher efficiency than incandescent lamps. Conventional LED lamps therefore consume a smaller amount of total electrical power in operation than comparable incandescent lamps.

There are known lights, however, such as traffic lights, in which a ballast permanently sets a total electrical power for an illuminant used with the light. If such a light is designed to use an incandescent lamp as illuminant, conventional LED lamps are not suitable as illuminants for that light.

It is, therefore, an object of the present invention to specify a method for generating an electrical dissipation power, a method for operating a light, an LED lamp, and a light comprising an LED lamp.

This object is achieved by means of the independent claims.

An LED lamp according to the invention comprises at least one LED (Light Emitting Diode) and at least one radiation-emitting semiconductor component. When the LED lamp is operating, the at least one LED emits visible light—for example green, yellow, red, blue and/or white light—and the at least one radiation-emitting semiconductor component emits electromagnetic radiation having a peak intensity outside the visible region of the spectrum. In particular, the at least one radiation-emitting semiconductor component emits electromagnetic radiation that contains no, or at least practically no, visible light. For example, the peak intensity is in the infrared or ultraviolet region of the spectrum.

The radiation-emitting semiconductor component serves to generate an electrical dissipation power by means of which a total electrical power consumed by the LED lamp in operation is made to match a predefined total electrical power. In contrast to power matching by means of other electrical or electronic components, such as resistors, for example, here the electrical power consumed by the radiation-emitting semiconductor component is not converted solely or primarily into heat, but is given off at least partly in the form of electromagnetic radiation, particularly in the form of relatively short-wave electromagnetic radiation with a wavelength of 10 μm or less, preferably 3 μm or less.

The radiation-emitting semiconductor component has little or no effect on the radiant power emitted by the LED lamp in the visible region of the spectrum. The total electrical power consumed by the LED lamp in operation can therefore be adjusted, by means of the electrical dissipation power consumed by the radiation-emitting semiconductor component, independently of the radiant power emitted by the LED lamp in the visible region of the spectrum.

The electromagnetic radiation emitted by the radiation-emitting semiconductor component can in a simple manner be coupled out of the LED lamp and/or out of a light equipped with such an LED lamp as illuminant. The waste heat generated by the LED lamp during operation is thereby reduced in comparison to an LED lamp in which the electrical dissipation power is generated by means of, for example, a resistor. This reduces the risk of shortening the lifespan of the LED lamp and/or lowering the efficiency of the LED, for example due to heating of the LED lamp and/or of the lamp housing. It also advantageously eliminates the need for an onerous and fault-prone cooling device, such as a fan.

In other words, an electrical dissipation power is generated in an LED lamp provided for emitting visible light. The electrical dissipation power targetedly increases a total electrical power consumed by the LED lamp during operation, and is generated by means of a radiation-emitting semiconductor component. During the operation of the LED lamp, the radiation-emitting semiconductor component emits electromagnetic radiation having a peak intensity outside the visible region of the spectrum. In this way, a portion of the electrical dissipation power is converted into radiant power and is dissipated from the LED lamp by means of the electromagnetic radiation emitted by the radiation-emitting semiconductor component.

In one configuration, the LED lamp has a standard electrical connection. In an improvement of this configuration, the LED lamp has a standard base comprising the standard electrical connection.

The term "standard electrical connection" is understood herein to mean an electrical connection that is commonly used for illuminants and in particular for incandescent lamps, and a "standard base" is correlatively understood to mean a base that is commonly used for illuminants and in particular for incandescent lamps. For example, the standard base can be an Edison base, a bayonet base, a plug-in base or a base with connecting cables.

An Edison base has an Edison thread, for example E14, E26 or E27, as its standard electrical connection and is commonly used, for example, in general lighting or for signal lights. A bayonet base comprises a bayonet lock. It is commonly used, for example, in motor vehicle lighting, for example having the type designation BAU15s, and in general lighting, e.g. under the type designations B15d and GU10, particularly for halogen incandescent lamps. A plug-in base, for instance a G9, GU5.3 or GY6 base, comprises in one configuration electrical connection pins as its standard electrical connection. In a base with connecting cables, at least two electrical connecting cables are run out of the base, and terminate, for example, in cable shoes. Such bases having a cable connection, for example Pk30d, are commonly used, for example, in lights for airfield illumination.

An LED lamp comprising such a standard electrical connection or standard base is suitable for replacing an incandescent lamp having such a standard electrical connection or standard base, respectively. In particular, both the radiant power emitted by the LED lamp in the visible region of the spectrum and the total electrical power consumed by the LED lamp in operation are respectively the same as the radiant power emitted in the visible region of the spectrum and the total electrical power consumed during operation by the replaced incandescent lamp. The lifespan of the LED lamp, however, is greatly prolonged in comparison to the lifespan of the incandescent lamp.

In one configuration, during the operation of the LED lamp, the LED emits visible light in a first solid angle region and the radiation-emitting semiconductor component emits electromagnetic radiation in a second solid angle region that is at least partially different from the first. In particular, the first solid angle region has a first central axis or central plane and the second solid angle region a second central axis or central plane, which, for example, enclose an angle of about 90° or of about 180°. The radiation characteristic of the LED or of the plurality of LEDs is, in particular, substantially symmetrical with respect to the first central axis or central plane. The radiation characteristic of the radiation-emitting semiconductor component or of the plurality of radiation-emitting semiconductor components is, in particular, at least substantially symmetrical with respect to the second central axis or central plane.

In one configuration, during the operation of the LED lamp, the at least one radiation-emitting semiconductor component consumes an electrical dissipation power that is greater than or equal to the first electrical power consumed by the at least one LED during the operation of the LED lamp. In an improvement of this configuration, the electrical dissipation power is at least twice the first electrical power.

The efficiency of the radiation-emitting semiconductor component is, in one configuration, greater than or equal to 40%: for example, the radiation-emitting semiconductor component has an efficiency of about 50%. Otherwise expressed, 40% or more of the electrical dissipation power is converted into electromagnetic radiation. Compared to power-matching the LED lamp by means of a resistor, the generated waste heat is therefore reduced by 40% or more.

In another configuration, the radiation-emitting semiconductor component is suitable for heating and/or de-icing an object at a distance from the LED lamp. Said object can be, for example, a radiation penetration surface of a light housing and/or a display board, such as a traffic sign, for example.

Alternatively or additionally, the LED lamp itself can have a radiation exit surface, which in particular is illuminated by the LED and by the radiation-emitting semiconductor component, and, that being the case, the radiation-emitting semiconductor component can, in one configuration of said LED lamp, be provided to de-ice the radiation exit surface.

For example, in a configuration in which the radiation-emitting semiconductor component is provided to de-ice the radiation exit surface of the LED lamp or of an object at a distance from the LED lamp, the radiation-emitting semiconductor component usefully emits electromagnetic radiation in the infrared region of the spectrum.

In an improvement, the radiation-emitting semiconductor component emits electromagnetic radiation having a wavelength of 1.45 μm or more, particularly a wavelength between 1.45 μm and 3 μm. Water has a comparatively high absorption coefficient for infrared radiation, especially for electromagnetic radiation with a wavelength of 1.45 μm or more. The electromagnetic radiation emitted by the radiation-emitting semiconductor component is absorbed by any water or ice that may be present on the object and/or on the radiation exit surface. The water and/or ice is thereby warmed, thus in particular bringing about the sublimation, melting, evaporation and/or vaporization of the water and/or the ice, or at least of a portion thereof.

In another improvement, the radiation exit surface of the LED lamp or of the object at a distance from the LED lamp is configured, at least in a subregion, as targetedly absorptive of the electromagnetic radiation from the radiation-emitting semiconductor component. For example, it is provided with a coating that at least partially absorbs the electromagnetic radiation. This can be useful, for example, if the absorption by water and/or ice of the radiation emitted by the radiation-emitting semiconductor component is not sufficient for de-icing. This can occur, for example, if the radiation-emitting semiconductor component emits relatively short-wave infrared electromagnetic radiation.

Further specified is a light comprising an illuminant, which light comprises such an LED lamp as illuminant. In one configuration, the light comprises a ballast, which in one configuration is provided to detect a failure of the illuminant.

In the light, the ballast and the LED lamp need not be disposed in a common light housing. In the present context, the term "light" is understood to include a lighting system in which the LED lamp and the ballast are spatially separated.

In one configuration, the light is a signal light used, for example, in a signal installation such as a traffic light or a railroad signal. In another configuration, the light is an airfield light. In the case of such a signal installation or airfield light, the ballast can, for example, be disposed in a separate switch box or buried in the airfield.

In yet another configuration, the light is a motor vehicle light, for example a taillight, a running light, a headlight or a flasher of a directional indicator. A flasher may also be useful in a signal installation. If the light is a motor vehicle light, the ballast, again, is not usually contained in the light housing that contains the LED, but is, for example, disposed separately therefrom, for example in the engine compartment.

In one configuration of the light, a predefined total electrical power is set by the ballast. The predefined total electrical power is, for example, adapted for operating the light with an incandescent lamp as illuminant. In an improvement thereto, to detect failure of the illuminant, the ballast is provided to detect a deviation of the total electrical power consumed by the illuminant during operation from the predefined total electrical power.

LED lamps normally have a higher efficiency than incandescent lamps. A conventional LED lamp therefore consumes less electrical power than an incandescent lamp, assuming equal radiant power emitted in the visible region of the spectrum. Such a conventional LED lamp thus is not suitable for use with the light, since the ballast would detect a deviation of the electrical power consumed by the illuminant during operation from the predefined total electrical power and would erroneously signal a malfunction of the illuminant.

In lights equipped with ballasts that set a total electrical power adapted to an incandescent lamp as the illuminant, the electrical power consumed by the LED lamp during operation must be made to match the total electrical power set by the ballast—particularly by increasing said power—for it to be possible to use the LED lamp with the light.

This is useful, for example, when the ballast is difficult or impossible to replace. The LED lamp does not, of course, consume less total electrical power in operation than the incandescent lamp it is replacing, which emits substantially the same radiant power in the visible region of the spectrum. But the LED lamp has a longer service life than an incandescent lamp, thereby for example reducing maintenance expenditure for the light.

Otherwise expressed, a method for operating a light is specified according to the invention. In the method, the light is operated with an LED lamp instead of an incandescent lamp. Said LED lamp comprises an LED or a plurality of LEDs, which, when the light is operating, emit visible light and consume a first electrical power. Furthermore, the LED comprises a radiation-emitting semiconductor component or a plurality of radiation-emitting semiconductor components, which, when the light is operating, emit electromagnetic radiation having a peak intensity outside the visible region of the spectrum and consume an electrical dissipation power.

The radiant power emitted by the LED or the plurality of LEDs is so selected according to the method that it is substantially the same as the radiant power emitted by the incandescent lamp in the visible region of the spectrum when the light is operating, whereas the first electrical power is lower than the total electrical power consumed by the incandescent lamp when the light is operating. The electrical dissipation power is so selected that when the light is operating, the LED lamp consumes substantially the same total electrical power as the incandescent lamp.

In one configuration, the light comprises a housing. The at least one radiation-emitting semiconductor component is provided, in one configuration, to de-ice at least one subregion of the housing. For example, the housing has a radiation penetration surface through which the light emitted particularly by the LED is coupled out, and the radiation-emitting semiconductor component is provided to de-ice the radiation penetration surface.

Figure 2:
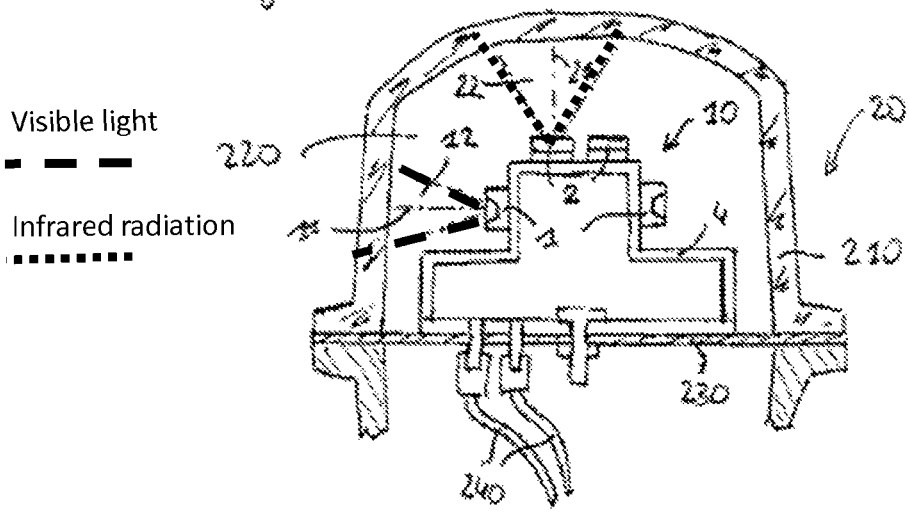
Figure 3:
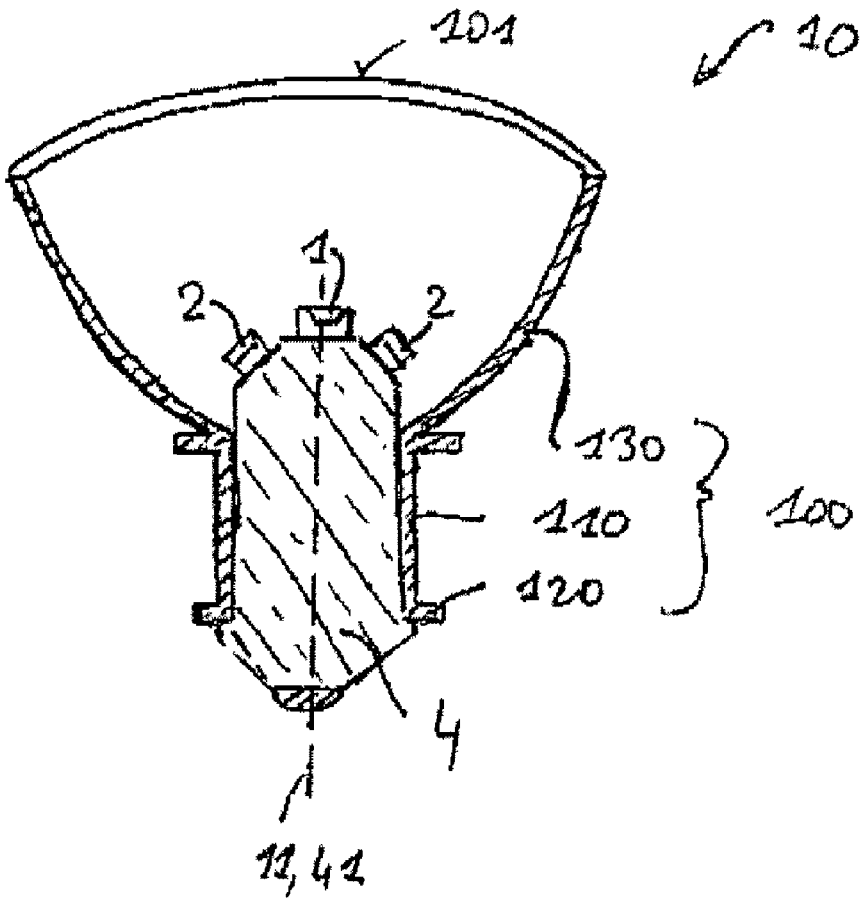

Further configurations of the LED lamp and of the light will emerge from the following exemplary embodiments, described in conjunction with FIGS. 1 to 3.

Therein:

FIG. 1 is a schematic sectional representation of a detail of a light, showing a schematic side view of an LED lamp according to a first exemplary embodiment, FIG. 2 is a schematic sectional representation of a light comprising an LED lamp according to a second exemplary embodiment, and FIG. 3 is a schematic sectional representation of an LED lamp according to a third exemplary embodiment.

In the figures, like or like-acting elements are provided with the same respective reference numerals. The figures and the size relationships of the elements shown are basically not to be considered true to scale. Rather, individual elements may be depicted as exaggeratedly large for the sake of better understanding and/or better visualization.

FIG. 1 shows an LED lamp 10 according to a first exemplary embodiment in a side view. The LED lamp 10 according to FIG. 1 is provided for use in a signal installation, for example a traffic light. The signal installation comprises at least one signal light having a light housing 20 that contains the LED lamp 10. A detail of the light housing 20 is depicted schematically in cross section in FIG. 1.

The LED lamp 10 in this particular case comprises a housing 100 with a radiation exit surface 101. The housing also has a standard base 110 provided with an Edison thread 120, for example an E27 thread, and disposed on the opposite side of the housing 100 from the radiation exit surface 101.

In FIG. 1, the housing 100 is shown broken away to expose the LED 1 disposed in the housing interior and, also disposed in the housing interior, radiation-emitting semiconductor components 2. The LEDs 1 and the radiation-emitting semiconductor components 2 are disposed, for example, on a common carrier, e.g. a circuit board 3.

In the present case, the carrier 3 extends substantially parallel to the radiation exit surface 101. Usefully at least the LEDs 1 are disposed on the side of the carrier 3 facing toward the radiation exit surface 101. In the present case, the radiation-emitting semiconductor components 2 are also disposed on the side[1] of the carrier 3 facing toward the radiation exit surface 101, so both the LEDs 1 and the radiation-emitting semiconductor components 2 illuminate the radiation exit surface 101.

[1]Translator's Note: The German actually has "sides," which we take to be an error (caused by the addition of just one letter, as in English).

In the LED lamp 10 according to the first exemplary embodiment, the LEDs 1 preferably emit light in the blue-green, green, yellow, orange or red region of the spectrum. The radiation-emitting semiconductor components 2 in the present case emit electromagnetic radiation in the infrared region of the spectrum. In particular, the radiation-emitting semiconductor components 2 emit electromagnetic radiation that contains no or at least practically no visible light, for example having a wavelength of less than or equal to 700 nm. For example, the electromagnetic radiation exhibits a peak intensity at a wavelength between 800 and 1000 nm, for example at 850 nm or 950 nm.

Each LED 1 and each radiation-emitting semiconductor component 2 comprises at least one semiconductor chip with an active region that emits electromagnetic radiation in response to the application of an operating electrical current. At least the active region is based on an inorganic semiconductor material, e.g. a III-V compound semiconductor such as InGaAlN, and/or an organic semiconductor material, e.g. a polymer or a low-molecular material ("small molecules"). The active region preferably includes a pn junction, a double heterostructure, a single quantum well (SQW) or a multiple quantum well (MQW) structure for generating radiation. The term "quantum well structure" carries no implication here as to the dimensionality of the quantization. It therefore includes, among other things, quantum troughs, quantum wires and quantum dots and any combination of these structures.

At least one LED 1 and/or at least one radiation-emitting semiconductor component 2, particularly each LED 1 and each radiation-emitting semiconductor component 2, preferably also comprises a housing, in which the semiconductor chip is disposed and which is provided for example with a reflector and/or a beam-shaping element such as a lens.

Contained in the housing 100 of the LED lamp 10, for example in the base 110, in one configuration, is a driver circuit for driving the LEDs 1 and the radiation-emitting semiconductor components 2. The driver circuit for example comprises a rectifier.

The base 110 of the LED lamp 10 is disposed in a holder in the light housing 20 (not shown in FIG. 1) and is electrically connected via the holder to a ballast of the light, which ballast delivers an operating current to the LED lamp 10 during operation. The ballast need not be contained in the light housing 20, but can alternatively be disposed outside the light housing 20, for example in a switch box.

The ballast is designed, for example, for an illuminant in the form of an incandescent lamp that consumes in operation an electrical power of 100 W. The ballast is, for example, further provided to detect a failure of the illuminant by detecting a deviation of the electrical power consumed by the illuminant from the predefined electrical dissipation power of 100 W. The ballast is also, in particular, suitable only for illuminants that consume in operation the predefined total electrical power of, in the present case, 100 W.

The LEDs 1 of the LED lamp 10 according to the first exemplary embodiment consume a first electrical power of, for example 20W when the LED lamp 10 is operating. The radiant power emitted by the LEDs 1 when the LED lamp 10 is operating is roughly the same as the radiant power emitted in the visible region of the spectrum by a 100 W incandescent lamp during operation.

So that the LED lamp 10 is suitable for operation with the ballast, it is made by means of the radiation-emitting semiconductor components 2 to match the total electrical power of 100 W set by the ballast. Hence, the radiation-emitting semiconductor components 2 consume an electrical dissipation power of, for example, 80 W during the operation of the LED lamp 10, causing the total electrical power consumed by the LED lamp during operation to equal 100 W. Otherwise expressed, the LED lamp and the incandescent lamp it replaces have the same ratio of radiant power emitted in the visible region of the spectrum and total electrical power consumed in operation.

The radiation-emitting semiconductor components 2 in the present case have an efficiency of about 50%. Thus, about 40 W are given off by the radiation-emitting semiconductor components 2 in the form of infrared radiation. The infrared radiation is emitted, at least in large part, through the radiation exit surface 101 of the LED lamp 1 along with the visible light emitted by the LEDs 1, and leaves the light housing 20 through window 210. Window 210 is usefully pervious, i.e. translucent or transparent, or at least partially pervious, to the visible light emitted by the LEDs 1 and to the infrared light emitted by the radiation-emitting semiconductor components 2. This reduces the amount of waste heat that must be dissipated by the LED lamp 10.

If the signal light according to the exemplary embodiment of FIG. 1 is installed out of doors, for example, a radiation penetration surface 211 of window 210 may—in cold and damp weather, for example—become at least partially covered with ice and/or snow that interferes with the visibility of the signal light. The infrared light emitted by the radiation-emitting semiconductor components 2 and coupled out through window 210 advantageously warms the snow and/or ice, thereby liquefying it or them, for example at least in an edge region of the ice and/or snow layer that is adjacent to radiation penetration surface 211. The radiation-emitting semiconductor components 2 are provided in this way to de-ice radiation penetration surface 211.

By way of example, should the radiation-emitting semiconductor components 2 emit electromagnetic radiation that is absorbed only slightly by the snow and/or ice, in an improvement, an absorptive layer or film is applied to radiation penetration surface 211 and targetedly absorbs some or all of the electromagnetic radiation emitted by the radiation-emitting semiconductor components 2. Alternatively, the window 210 can also be configured as partially or completely absorptive of the electromagnetic radiation. In this fashion, the absorptive layer or film or the window is warmed by the absorbed electromagnetic radiation, particularly causing the ice and/or snow to melt, at least in the edge region adjacent the window 210.

An LED lamp 10 according to a second exemplary embodiment is schematically illustrated in cross section in FIG. 2. The LED lamp 10 is disposed in the interior 220 of a of a light housing 20, here in the light housing 20 of an airfield light. It is attached to a mounting plate 230 and, in order to be supplied with an operating current, is connected by cables 240 to a ballast, which for example is buried in the ground of the airfield.

A window 210 of the light housing 20 at least partially encompasses the LED lamp 10 in the present case. Otherwise expressed, the LED lamp 10 is disposed at least in part in a depression of the window 210 in the interior 220 of the light housing 20.

The LEDs 1 and the radiation-emitting semiconductor components 2 in the present case are attached to a base part 4 of the LED lamp. The base part 4 has in the present case a circumambient lateral surface, or alternatively a plurality of lateral surfaces, to which the LEDs 1 are attached. The radiation-emitting semiconductor components 2 are attached to a front surface of the base part 4 that faces away from the mounting plate 230.

The LEDs 1 emit visible light in a first solid angle region 12 having a first central axis 11. The first central axes 11 of the LEDs 1 lie in a common central plane, which in FIG. 2 is horizontal. The LED lamp according to FIG. 2 emits visible light in an annular solid angle region. The radiation-emitting semiconductor components 2 emit infrared radiation in a second solid angle region 22 having a second central axis 21. All the second central axes 21 are parallel to one another in the present case. The first and second central axes 11, 21 are perpendicular to each other in the present case. The first and second solid angle regions 12, 22 are disjoint in the present case, and thus do not overlap here.

The electromagnetic radiation, particularly the infrared radiation, emitted by the radiation-emitting semiconductor components 2 is coupled out through a front surface of the window 210, through which a central axis of the LED lamp 10 and of the light housing 20 passes in the present case. The visible light emitted by the LEDs 1 exits the light housing 20 through at least one side wall of the window 210, which here extends annularly around the front surface.

By way of example, when used in an airfield lighting system, the LED lamp 10 replaces a halogen incandescent lamp, or halogen lamp for short. The halogen lamp consumes in operation, for example, an electrical power of 30 W. Assuming the same emitted radiant power in the visible region of the spectrum, the LEDs 1 consume a first electrical power of 9 W. In the first exemplary embodiment, the ballast monitors the power consumption and registers a malfunction of the illuminant if the total electrical power consumed in operation deviates by a given amount from the predefined total electrical power of, in the present case, 30 W. The LED lamp 10 contains the radiation-emitting semiconductor components 2 in order to consume an electrical dissipation power of 21 W during the operation of the LED lamp 10 and thus to match the total electrical power to the predefined total electrical power.

The LED lamp depicted in FIG. 2 has a base part 4 with electrical connection pins, to which, for example, are mated cable shoes of the cable 240. The base part 4 in the present case is bolted to the mounting plate 230. Alternatively, the LED lamp can also have another standard base, for example a base with connecting cables, which are led out of the base and terminate particularly in cable shoes. The base is, for example, a recessed base, which is press-fitted into a holder. The holder in the present case is, for example, attached to the mounting plate 230. Such a base with connecting cables is commonly used, under the designation "Pk30d," for incandescent lamps employed as airfield lights. Alternatively or additionally, the LED lamp can, in contrast to the configuration shown in FIG. 2, comprise a housing 100 which in particular encompasses the LEDs 1 and the radiation-emitting semiconductor components 2.

FIG. 3 shows a schematic cross section through an LED lamp 10 according to a third exemplary embodiment, which is provided for example to be used in a flasher of a directional signal of a motor vehicle.

An LED 1, which consumes a first electrical power of, for example, 2 W when the LED lamp 10 is operating, is disposed on a base part 4 along with two radiation-emitting semiconductor components 2, which together consume an electrical dissipation power of, for example, 3 W when the LED lamp 10 is operating.

The LED 1 emits visible light in a first solid angle region 12. The LED 1 is disposed on the base part in the present case, in such a way that the first central axis 11 of the first solid angle region 12 coincides with a central axis 41 of the base part 4. The cross section of the base part widens in the direction away from the central axis 41 of the LED 1, such that the lateral surfaces or the circumambient lateral surface present a subregion that is adjacent the LED 1 and extends obliquely to the central axis 41. Both of the radiation-emitting semiconductor components 2 are attached to this subregion.

The base part 4 is partially disposed in a housing 100 of the LED lamp 10. An end piece of the base part 4 that is disposed oppositely from the LED 1 protrudes from the housing 100 and presents a first electrical connection site. This, together with a base region 110 of the housing that constitutes a second electrical connection site, constitutes a standard base and is suitable to be fixed in a holder and to electrically connect the LED lamp 10. The standard base in the present instance is a bayonet base, for example of the BAU15s type, and comprises, for fixing purposes, pins 120 of a bayonet lock on the base region 110 of the housing 100.

A subregion of the housing 100, which subregion encompasses the LED 1 and the radiation-emitting semiconductor components 2, forms a reflector 130 for visible light emitted by the LED 1 and, in the present case, also for the infrared radiation emitted by the radiation-emitting semiconductor components 2. In the third exemplary embodiment, the central axes 21 of the second solid angle regions 22 in which electromagnetic radiation is emitted by the radiation-emitting semiconductor components 2 extend in different directions. The reflector in the present case directs at least a portion of the infrared radiation emitted by the radiation-emitting semiconductor components 2 to a radiation penetration surface 211 of a window 210 of the housing 20 of the flasher (not shown in FIG. 3), causing the window 210 to be de-iced if necessary.

The invention is not limited to the exemplary embodiments by the description of it with reference thereto. Rather, the invention encompasses any novel feature and any combination of features, including in particular any combination of features recited in the claims, even if that feature or combination itself is not explicitly mentioned in the claims or exemplary embodiments.

For purposes of simplification, the electrical wiring of the LEDs 1 and of the radiation-emitting semiconductor components 2 and their electrical connection to the electrical connection sites of the base 110 and/or of the base part 4 and to the ballast have been omitted from the figures. The design of the electrical wiring is known in principle to those skilled in the art and therefore is not described in detail.

The invention claimed is:

1. An LED lamp configured to be used with a light having a predefined total electrical power, the LED lamp comprising:

an LED operable to emit visible light wherein, during operation, said at least one LED consumes a first electrical power; and at least one radiation-emitting semiconductor component operable to emit electromagnetic radiation having a peak intensity outside the visible region of the spectrum;

wherein said at least one radiation-emitting semiconductor component consumes an electrical dissipation power that is greater than or equal to said first electrical power, the electrical dissipation power selected such that a total electrical power consumed by the LED lamp in operation matches the predefined total electrical power.

2. The LED lamp as in claim 1, wherein said peak intensity is in the infrared or ultraviolet region of the spectrum.

3. The LED lamp as in claim 1, wherein said LED emits visible light in a first solid angle region and said radiation-emitting semiconductor component emits electromagnetic radiation in a second solid angle region that is at least partially different from the first.

4. The LED lamp as in claim 1, wherein said electrical dissipation power is at least twice said first electrical power.

5. The LED lamp as in claim 1, wherein an efficiency of said radiation-emitting semiconductor component is greater than or equal to 40%.

6. The LED lamp as in claim 1, comprising a radiation exit surface that is illuminated by said LED and by said radiation-emitting semiconductor component.

7. The LED lamp as in claim 6, wherein said radiation-emitting semiconductor component is configured to de-ice said radiation exit surface.

8. The LED lamp as in claim 1, comprising a standard electrical connection.

9. The LED lamp as in claim 8, comprising a standard base that comprises a standard electrical connection.

10. The LED lamp as in claim 9, wherein said standard base is an Edison base, a bayonet base, a plug-in base or a base with connecting cables.

11. A light comprising an illuminant, the illuminant comprising an LED lamp as in claim 1.

12. The light as in claim 11, which light is a motor vehicle light.

13. The light as in claim 11, which light is an airfield light.

14. The light as in claim 11, comprising a ballast that detects a deviation of electrical power consumed by said illuminant during operation from a predefined total electrical power.

15. The light as in claim 14, wherein said total electrical power set by said ballast is adapted for operating said light with an incandescent lamp as illuminant.

16. The light as in claim 11, which light is a signal light.

17. The light as in claim 16, which light is a flasher.

18. The light as in claim 11 and comprising an LED lamp wherein said radiation-emitting semiconductor component is suitable for warming and/or de-icing an object at a distance from said LED lamp, wherein said light comprises a housing and said radiation-emitting semiconductor component is configured to de-ice at least one subregion of said housing.

19. The light as in claim 18, wherein said housing comprises a radiation penetration surface and said radiation-emitting semiconductor component is configured to de-ice said radiation penetration surface.

20. A method for dissipating an electrical dissipation power in association with an LED lamp operable to emit visible light, the method comprising:

targetedly increasing a total electrical power consumed by said LED lamp during operation by operating a radiation-emitting semiconductor component to emit electromagnetic radiation having a peak intensity outside the visible region of the spectrum, the electrical dissipation power selected such that a total electrical power consumed by the LED lamp in operation matches a predefined total electrical power, and dissipating a portion of said electrical dissipation power by radiating, out of said LED lamp, the electromagnetic radiation emitted by said radiation-emitting semiconductor component wherein, during operation, at least one LED of the LED lamp consumes a first electrical power and at least one radiation-emitting semiconductor component of the LED lamp consumes an electrical dissipation power that is greater than or equal to said first electrical power.

* * * * *